US005487263A

United States Patent [19]

Scheufeld et al.

[11] Patent Number: 5,487,263

[45] Date of Patent: Jan. 30, 1996

[54] DEVICE FOR ADJUSTING CAPSULE THREAD BRAKES IN TWISTING MACHINES, IN PARTICULAR TWO-FOR-ONE TWISTERS

[75] Inventors: Heinz Scheufeld, Korschenbroich; Ulrich Lossa, Krefeld; Heinz Stenmans, Grefrath, all of Germany

[73] Assignee: Palitex Project-Company GmbH, Krefeld, Germany

[21] Appl. No.: 226,959

[22] Filed: Apr. 13, 1994

[30] Foreign Application Priority Data

Apr. 13, 1994 [DE] Germany ..... 43 11 999.9

[51] Int. Cl.[6] ..... D01H 1/10; D01H 7/86

[52] U.S. Cl. ..... 57/58.86; 57/113; 57/279; 242/152.10

[58] Field of Search ..... 57/279, 58.83, 57/58.86, 113; 242/147, 152.1

[56] References Cited

U.S. PATENT DOCUMENTS

| | | | |
|---|---|---|---|
| 3,975,893 | 8/1976 | Franzen | 57/34 R |
| 4,281,508 | 8/1981 | Beyme | 57/58.86 |
| 4,287,712 | 9/1981 | Franzen | 57/58.86 |
| 4,468,920 | 9/1984 | Lorenz | 57/279 |
| 4,782,653 | 11/1988 | Yanobu | 242/147 R X |
| 5,155,988 | 10/1992 | Nieratschker | 57/58.86 |

FOREIGN PATENT DOCUMENTS

| | | | |
|---|---|---|---|
| 1497288 | 8/1967 | France | 57/58.86 |
| 1497050 | 8/1967 | France | 57/58.86 |
| 1510792 | 9/1963 | Germany . | |
| 1510853 | 7/1965 | Germany . | |
| 1510860 | 10/1965 | Germany . | |
| 2461796 | 12/1974 | Germany . | |
| 2938673 | 4/1981 | Germany | 57/279 |
| 3000443 | 7/1981 | Germany | 242/147 R |
| 3243157 | 5/1984 | Germany . | |
| 636578 | 12/1978 | Switzerland . | |
| 636577 | 12/1978 | Switzerland . | |
| 2024878 | 1/1980 | United Kingdom | 57/58.86 |

*Primary Examiner*—Daniel P. Stodola
*Assistant Examiner*—William Stryjewski
*Attorney, Agent, or Firm*—Robert W. Becker & Associates

[57] ABSTRACT

A device for adjusting capsule thread brakes in twisting machines having inside the twisting spindle a capsule thread brake has a brake ring disposed on a brake ring support which may be moved against a spring force. On the brake ring support a ring piston is arranged, which is guided in a ring cylinder connected to a compressed air supply line. A first toothed segment with downwardly directed teeth is arranged on the periphery of the brake ring support, and a second toothed segment with upwardly directed teeth is located opposite the first toothed segment. A support stop engages the slots formed between the teeth of the toothed segments during displacement of the brake ring support. The tooth flanks of the two toothed segments are provided with inclined surfaces in such a way that an upward and downward movement of the brake ring support results in a rotation of the brake ring support by predetermined angle values and an adjustment of the capsule thread brake as a consequence of the support stop abutting against slot bottoms at different axial heights. Several capsule thread brakes may be adjusted simultaneously by a central control device with compressed air pulses supplied by a common compressed air supply line.

16 Claims, 7 Drawing Sheets

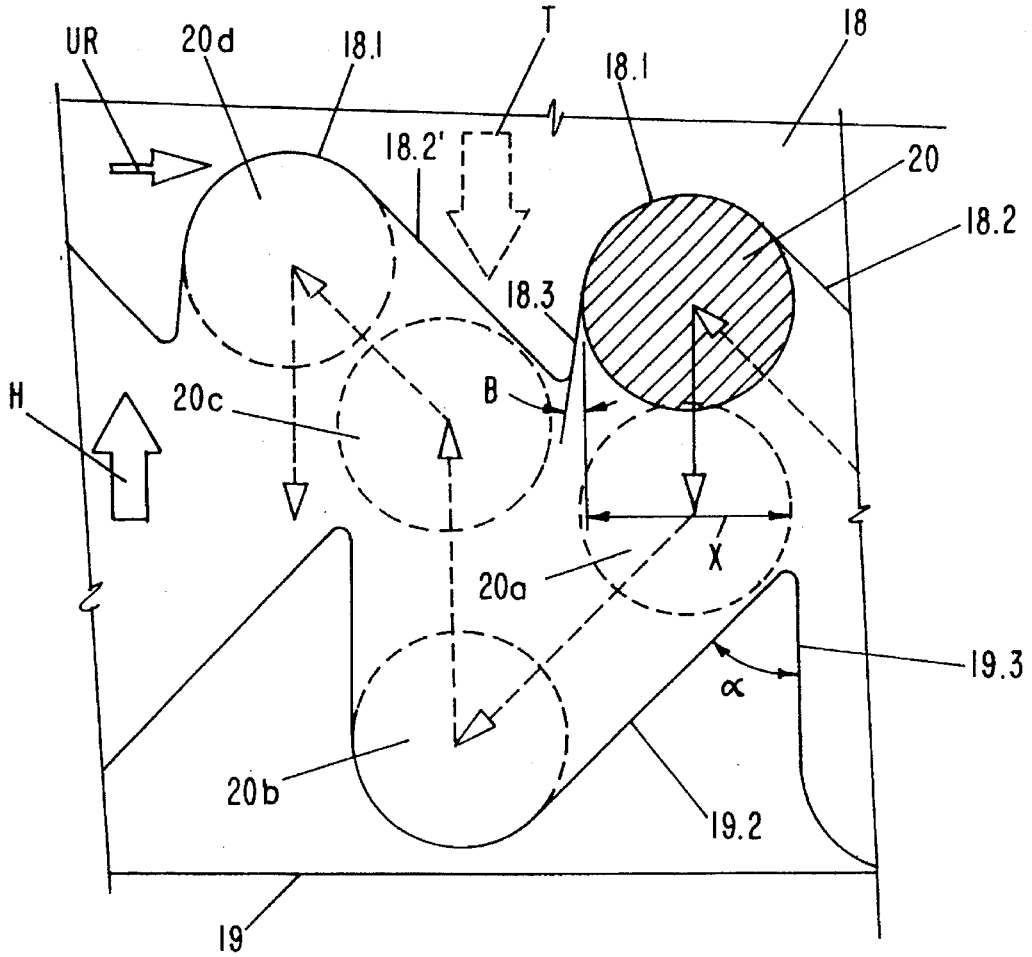
FIG—4
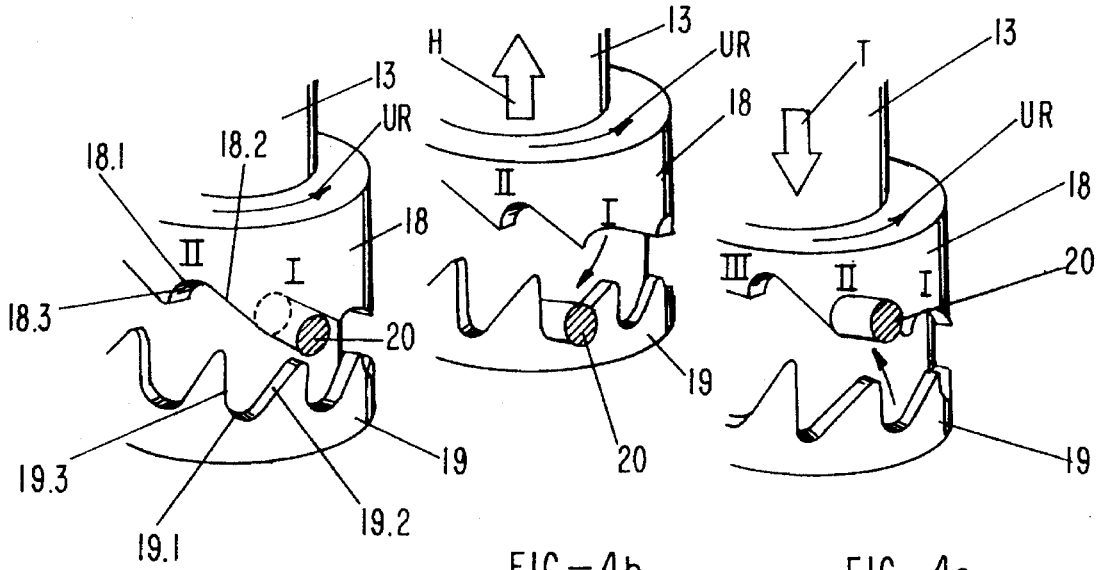
FIG—4a
FIG—4b
FIG—4c

DEVICE FOR ADJUSTING CAPSULE THREAD BRAKES IN TWISTING MACHINES, IN PARTICULAR TWO-FOR-ONE TWISTERS

BACKGROUND OF THE INVENTION

The invention relates to a device for adjusting capsule thread brakes in twisting machines, in particular two-for-one twisters with several twisting spindles, in which each of the capsule thread brakes, each arranged inside the hub of the bobbin carrier of the twisting spindles and provided with a brake cartridge supported between two brake rings positioned one above the other in the axial direction, may be adjusted in steps to different brake force values by axial displacement and rotation. The invention also relates to a device on a twisting machine, in particular a two-for-one twister, with at least one twisting spindle, which has a bobbin carrier and wherein a capsule thread brake with a cylindrical housing is arranged inside the hub of the bobbin carrier, through which the thread is passed in the axial direction and which on the thread outlet side has a first brake ring, on which a brake cartridge is supported, on the upper end of which a second brake ring sits. At least one of the brake rings is arranged on a cylindrical brake ring support movable in the axial direction within the housing. A pressure spring acts on the side of the brake ring support facing away from the brake ring and is supported on the housing with its respective other end.

Such a capsule thread brake for twisting machines is described in German Patent 1 510 860, for example. The capsule thread brakes have a brake cartridge with an upper and a lower sleeve, which are joined onto one another so as to be freely movable and have a pressure spring enclosed between them. In the known capsule thread brake, the brake force is adjusted manually, whereby the brake ring support is raised in the axial direction against the bias of the pressure spring, rotated around its axis by a specific angle and then lowered by the action of the pressure spring into a new position, in which the support stop rests on one of the support shoulders arranged at different axial heights inside one of the axial slots. This brake force adjustment must be carried out manually on each individual twisting spindle in a twisting machine.

Thread brakes are also known, which may be adjusted centrally at the same time. However, these brakes are, for example, in the form of disc brakes (see Swiss Patent 636 577) which are actuated by compressed air.

A device for controlling thread brakes on a two-for-one twister is also known (see German Patent 1 510 853), in which a thread brake can be operated by means of an electromagnetic control device acting through the circulating thread balloon. In one embodiment of this known thread brake, an oval brake sleeve sits between two brake rings, one of which is mounted to move axially on an elastically expandable bellows which is filled with a fluid medium and connected via a pipe to a further bellows, which is filled with the same medium and on which a pressure is exerted by means of the electromagnetic control device. The pressure is transferred to the first bellows, thus applying a pressure to the axially movable brake body which results in an increase in the brake force. However, in this known device, which may also be actuated centrally, the brake force can only be adjusted within narrow limits.

It is therefore an object of the present invention to provide in a twisting machine of the aforementioned kind central actuation of the capsule thread brake, which should be structurally simple and operationally reliable in association with a large manufacturing range.

SUMMARY OF THE INVENTION

The device for adjusting the braking power of capsule thread brakes of spindles of at least one twisting machine according to the present invention is primarily characterized by:

a plurality of twisting spindles each having a bobbin carrier with a hub and a capsule thread brake with a step-wise adjustable braking power positioned in the hub, the capsule thread brake comprising:

a) two brake rings arranged axially spaced from one another, wherein the braking power is adjusted by axially displacing and rotating one of the brake rings, b) a brake cartridge supported between the two brake rings, and c) a pressure cylinder coupled to one of the brake rings;

a common compressed air supply line for supplying compressed air, the compressed air supply line having a control device;

a connector connected to each spindle, wherein the compressed air supply line communicates via the connectors with the pressure cylinders, wherein the control device supplies compressed air pulses through the common compressed air supply line and the connectors to the pressure cylinders to affect simultaneously an axial displacement by a predetermined distance of one of the brake rings of all the capsule thread brakes.

Preferably, each capsule thread brake has a cylindrical housing through which cylindrical housing the thread is guided in the axial direction, wherein a first brake ring is positioned at a lower end of the cylindrical housing and wherein the brake cartridge is supported on the first brake ring and a second brake ring is positioned at the upper end of the brake cartridge. The device further comprises:

a cylindrical brake ring support for supporting one of the brake rings, the brake ring support arranged so as to be axially slidable within the cylindrical housing;

a pressure spring for supporting the brake ring support at the housing, said pressure spring resting with one end on a side of the brake ring support opposite the brake ring and with the other end on said housing;

a cylindrical guide element that is axially slidable and rotatable within the housing together with the brake ring support;

the guide element having a first toothed segment with first teeth distributed directly adjacent to one another in the circumferential direction of the guide element, the first teeth defining therebetween first axial slots with a first slot bottom functioning as support shoulders, wherein the first slot bottoms are positioned at different axial heights of the guide element, wherein a leading flank of the first axial slots in the circumferential direction extends downwardly at an acute angle of less than 90° to the circumferential direction and wherein a rearward flank of the first axial slots in the circumferential direction extends substantially axially;

the guide element having a second toothed segment with second teeth distributed directly adjacent to one another in the circumferential direction of the guide element, the second toothed segment positioned opposite the first toothed segment, wherein the second teeth define therebetween second axial slots with a second slot bottom, the second axial slots opening toward the first axial slots, wherein a leading flank of the second axial slots in the circumferential direction extends upwardly at an acute angle of less than 90° to the circumferential direction and wherein a rearward flank of the second axial slots in the circumferential direction extends substantially axially;

the second toothed segment being staggered in the circumferential direction relative to the first toothed segment such that the leading flanks of the first axial slots are positioned opposite the slot bottoms of the second axial slots and the leading flanks of the second axial slots are positioned opposite the slot bottoms of the first axial slots;

a radially inwardly projecting support stop for engaging the first axial slots of the first toothed segment such that as a function of an angular position of the guide element in a circumferential direction the support stop is inserted into the axial slots and brought into contact with the slot bottoms;

the pressure cylinder positioned within the housing;

a piston connected radially outwardly to the guide element so as to be coaxial thereto, the piston guided within the pressure cylinder;

the pressure cylinder communicating with the compressed air supply line via a first end of the pressure cylinder remote from the piston;

a pressure line connected to the first end of the pressure cylinder and guided through the housing to a connection opening external to the bobbin carrier; and the connector having a first movable connecting device connected to the compressed air supply line for connecting the connector to the connection opening positioned opposite to the first connecting device of the connector.

Advantageously, the acute angle of the leading flank of the first teeth is equal to the acute angle of the leading flank of the second teeth.

Expediently, the axial heights of the slot bottoms of the first teeth decrease in one direction about the circumference and a height of the second teeth increases in the same direction about the circumference.

Preferably, the first toothed segment is staggered relative to the second toothed segment by a distance that equals substantially 0.4 to 0.6 the spacing between the teeth.

Advantageously, the guide element is arranged coaxially to the brake ring support and is fixedly connected thereto. The brake ring support supports the second brake ring and is rotatable. The support stop is fixedly connected to an inner wall of the housing. The piston is a ring piston extending toward the brake cartridge. The pressure cylinder is a ring cylinder, wherein the pressure line is guided through the bottom of the bobbin carrier radially outwardly. The bobbin carrier has a protective pot, with the connection opening positioned in the protective pot.

In a preferred embodiment of the present invention, the connector comprises a guide cylinder connected to the compressed air supply line, a slide piston guided within the guide cylinder, and a piston spring biasing the slide piston into an end position within the guide cylinder remote from the bobbin carrier. The slide piston is movable radially relative to the bobbin carrier from the end position against the force of the piston spring toward the bobbin carrier. The first connecting device is connected to the slide piston and is in the form of a plunger extendable from and retractable into the guide cylinder. The plunger has a free end with a ball valve comprising a valve spring for biasing the ball valve into a closed position. The connection opening has a receiving element for the plunger. The receiving element has a conical opening element fixedly connected thereto that upon introduction of the plunger into the connection opening opens the ball valve.

Preferably, the connection opening further comprises a gasket.

Advantageously, the bobbin carrier further comprises a balloon limiter and the balloon limiter has a bore opposite the connector that is penetrated by the plunger when the plunger is displaced radially toward the bobbin carrier.

In another embodiment of the present invention, the bobbin carrier further comprises a compressed air supply unit for a threading device. The connector comprises a first guide cylinder connected to the compressed air supply line, a first slide piston guided within the first guide cylinder, and a first piston spring biasing the first slide piston into an end position within the first guide cylinder remote from the bobbin carrier. The connector further comprises a second guide cylinder connected to a further compressed air supply line, a second slide piston guided within the second guide cylinder, and a second piston spring biasing the second slide piston into an end position within the second guide cylinder remote from the bobbin carrier. The second guide cylinder is positioned adjacent to the first guide cylinder so as to be coaxial to the first guide cylinder. The first slide piston is movable radially relative to the bobbin carrier from the end position against the force of the first piston spring toward the bobbin carrier. The second slide piston is movable radially relative to the bobbin carrier from the end position against the force of the second piston spring toward the bobbin carrier. A first connecting device is connected to the first slide piston and is in the form of a first plunger extending from the first guide cylinder, wherein the first plunger has an axially extending compressed air channel. The connector further comprises a second movable connecting device that is connected to the second slide piston and is in the form of a second plunger extending from the first guide cylinder, wherein the first plunger extends coaxially into the second plunger and has a length such that, when the first slide piston is displaced from the end position toward the bobbin carrier, the first plunger projects past a free end of the second plunger. The connection opening receives the second plunger. The bobbin carrier has a receiving element for the first plunger positioned radially inwardly relative to the connection opening, wherein the connection opening is connected to a compressed air feed line connected to the threading device and wherein the receiving element is connected to the pressure line connected to the pressure cylinder.

Preferably, the receiving element has a sealing device for sealing the interior of the receiving element relative to the interior of the connection opening. The sealing device comprises a valve element and a spring for biasing the valve element into a closed position. The valve element is displaced into an open position by the first plunger when the first plunger is displaced by the first slide piston toward the bobbin carrier and is inserted into the receiving element.

The first plunger has a free end with a ball valve comprising a valve spring for biasing the ball valve into a closed position for closing off the compressed air channel. The valve element has an opening element for opening the ball valve when the first plunger is introduced into the receiving element.

The bobbin carrier further comprises a balloon limiter and the balloon limiter has a bore opposite the connector penetrated by the first and the second plungers when the first and the second plungers are displaced radially toward the bobbin carrier.

Advantageously, the brake ring support supports the first brake ring. The pressure spring biases the brake ring support in an upward direction. The guide element is positioned coaxially and radially outwardly relative to the brake ring support and is supported on the brake ring support and comprises a compression spring for biasing the guide element in a downward direction against the force of the pressure spring. The compression spring has a greater spring force than the pressure spring. The support stop is fixedly connected to an inner wall of the housing. The piston is a ring piston extending away from the brake cartridge. The pressure cylinder is a ring cylinder, wherein the pressure line is axially guided through a bottom of the bobbin carrier. The bobbin carrier has a spindle rotor and a supply channel extending axially through the spindle rotor, the supply channel having at an outer end thereof the connection opening.

In another embodiment of the present invention, each capsule thread brake has a cylindrical housing through which housing the thread is guided in the axial direction. A first brake ring is positioned at a lower end of the housing, wherein the brake cartridge is supported on the first brake ring and a second brake ring is positioned at the upper end of the brake cartridge. The device further comprises:

a cylindrical brake ring support for supporting the first brake ring, the brake ring support arranged so as to be axially slidable within the housing;

a pressure spring for supporting the brake ring support at the housing, the pressure spring resting with one end on a side of the brake ring support opposite the brake ring and with the other end on the housing for biasing the brake ring support in an upward direction;

a cylindrical guide element axially slidable and rotatable within the housing together with the brake ring support and coaxially fixedly connected to the brake ring support;

the guide element having a first toothed segment with first teeth distributed directly adjacent to one another in the circumferential direction of the guide element, the first teeth defining therebetween first axial slots with a first slot bottom, the first axial slots opening toward the brake cartridge, wherein the first slot bottoms are positioned at different axial heights of the guide element, wherein a leading flank of the first axial slots in the circumferential direction extends upwardly at an acute angle of less than 90° to the circumferential direction and wherein a rearward flank of the first axial slots in the circumferential direction extends substantially axially;

the guide element having a second toothed segment with second teeth distributed directly adjacent to one another in the circumferential direction of the guide element, the second toothed segment positioned opposite the first toothed segment, wherein the second teeth define therebetween second axial slots with a second slot bottom, the second axial slots opening toward the first axial slots, wherein a leading flank of the second axial slots in the circumferential direction extends downwardly at an acute angle of less than 90° to the circumferential direction and wherein a rearward flank of the second axial slots in the circumferential direction extends substantially axially;

the second toothed segment being staggered in the circumferential direction relative to the first toothed segment such that the leading flanks of the first axial slots are positioned opposite the slot bottoms of the second axial slots and the leading flanks of the second axial slots are positioned opposite the slot bottoms of the first axial slots;

a radially inwardly projecting support stop for engaging the axial slots of the first toothed segment such that as a function of an angular position of the guide element in a circumferential direction the support stop is inserted into the axial slots and brought into contact with the slot bottoms of the first axial slots;

a guide member positioned radially outwardly and coaxially to the guide element and axially slidable;

the support stop fixedly connected to an inner wall of the guide member;

the guide member comprising a compression spring biasing the guide member in an upward direction;

the compression spring having a greater spring force than the pressure spring;

the pressure cylinder positioned within the guide member;

a piston connected radially outwardly to the guide element so as to be coaxial thereto, the piston guided within the pressure cylinder;

the pressure cylinder communicating with the compressed air supply line via a first end of the pressure cylinder;

the connector having a first movable connecting device connected to the compressed air supply line for connecting the connector to the connection opening positioned opposite to the first connecting device of the connector;

the bobbin carrier comprising a spindle rotor having a thread guide tube with an outwardly extending section and having an inlet channel extending axially through the spindle rotor and having at an outer end thereof the connection opening;

the pressure cylinder communicating via a through opening with the thread guide tube; and the bobbin carrier further having an injector connected to the inlet channel and opening into the outwardly extending section.

Advantageously, the guide member at an upper end thereof is in the form of an annular piston guided within an annular cylinder. The bobbin carrier further comprises a threading device with an injecting member and a compressed air inlet. The annular cylinder has a connecting line communicating with the compressed air inlet of the threading device.

According to the present invention, for a centrally controlled adjustment of all capsule thread brakes of a twisting machine or several twisting machines at the same time, a control device is provided, from which compressed air pulses are emitted and passed to the pressure cylinders, coupled to the brake rings, via a common compressed air supply line and connectors arranged on each twisting spindle. The compressed air pulses cause an axial displacement by a predetermined length of the brake rings of all the capsule thread brakes. A twisting machine with an inventive device for adjusting a capsule thread brake is characterized by a cylindrical guide element, which may be axially moved and rotated together with the brake ring support and which has several support shoulders on its periphery in the form of axial slots opening towards the brake cartridge. The axial slots have slot bases positioned at different axial heights. Into the axial slots, depending in each case on the angle position in the circumferential direction of the guide element, a support stop, arranged opposite the guide element and projecting radially inwardly, may be inserted upon axial displacement of the guide element and may abut against the slot base (support shoulder). A piston disposed in the pressure cylinder arranged in the housing is arranged radially outside the brake ring and coaxially thereto on the guide element, and the pressure cylinder is connected at its end opposite to the ring piston to a pressure line subjectable to pressure and directed outward to a connection opening outside the bobbin carrier. Located opposite the connection opening is a movable connecting device of a connector connected to the compressed air supply line source. The axial slots are provided in the form of intermediate spaces on a first toothed segment with first teeth directly adjoining one another in the peripheral (circumferential) direction. The tooth flank leading in the circumferential direction (direction of rotation of the guide element) is provided in the form of a downwardly inclined surface extending at a predetermined acute angle of <90° to the peripheral (circumferential) direction, whereas the respective rearward tooth flank extends essentially in the axial direction. A second toothed segment is located opposite the first toothed segment at a predetermined axial distance and has second teeth facing the first teeth of the first toothed segment, wherein the tooth flank leading in the circumferential direction is provided in the form of an upwardly inclined surface extending at a predetermined acute angle of <90° to the peripheral direction, whereas the respective rearward tooth flank extends essentially in the axial direction. The second toothed segment is offset in the peripheral (circumferential) direction in relation to the first toothed segment by a predetermined magnitude, which ensures that in each case an inclined surface of the first toothed segment is located opposite a slot base of the second toothed segment, and conversely, an inclined surface of the second toothed segment is located opposite a slot base of the first toothed segment.

The basic concept of the invention is to further develop the capsule thread brake according to German Patent 1 510 860 in such a way that the brake ring support, or the guide element connected thereto, is automatically axially movable and during the axial movement automatically completes a rotation about a predetermined angle value to move it at intervals into positions, in which, after the brake ring support has returned axially, the support stop sits on a support shoulder (slot base) arranged at a different axial height, thus effecting the adjustment of the brake force.

As will be explained in further detail below by means of examples, the two opposing toothed segments on the brake ring support or guide element may be structured in such a way that a sufficient number of brake adjustments is achievable over the desired brake force range, and a reliable and automatic rotation of the brake ring support at the desired angle values is achieved on the basis of the special configuration of the opposing inclined surfaces, while the brake ring support is pushed back and forth by means of compressed air and spring force.

It is, of course, also possible to design the system by kinematic reversal of the conditions in such a way that the support shoulders are arranged on the inside of the housing, whereas a support stop is arranged on the periphery of the guide element so as to project radially outwardly and be insertable into the axial slots.

The compressed air pulses required for raising the brake ring support are supplied via a pressure line, which is passed through the hub of the bobbin carrier and the bobbin carrier base and may, for example, be directed radially outwardly onto the wall of the protective pot to a connection opening in the outer shell of the protective pot The connection opening is located opposite a radially (relative to the bobbin carrier) movable connecting device of a connector connected to the compressed air source (compressed air supply line). The term "compressed air pulse" here should be understood to mean in the scope of the invention a short increase in pressure in the compressed air supply line followed by a release of pressure, or a short drop in pressure followed by a further increase in the sense of an "under-pressure pulse". The connectors of all twisting spindles of a twisting machine are connected to a common compressed air supply line, in which a control device is provided to generate compressed air pulses.

The invention provides the advantageous possibility of combining the actuation of the thread brake by means of compressed air with the actuation known per se of a threading device by means of compressed air, as is described in German Patent 2 461 796 or U.S. Pat. No. 3,975,893, for example. In this way, the threading process and the adjustment of the capsule thread brake may both be carried out centrally via one connector or two connectors for each twisting spindle. This leads to a substantial reduction in set-up times in the case of multipoint machines.

Overall, quite a considerable amount of time is gained with the device of the present invention in the operation of twisting machines.

BRIEF DESCRIPTION OF THE DRAWINGS

Examples for a twisting machine according to the invention are explained in more detail below on the basis of the attached drawings.

FIG. 4 shows an enlarged schematic representation of the relative movement of the support stop at the brake ring support according to FIG. 3;

FIGS. 4*a*–4*c* show a perspective partial view of the brake ring support according to FIG. 3 in different positions;

DESCRIPTION OF PREFERRED EMBODIMENTS

Figure 1:
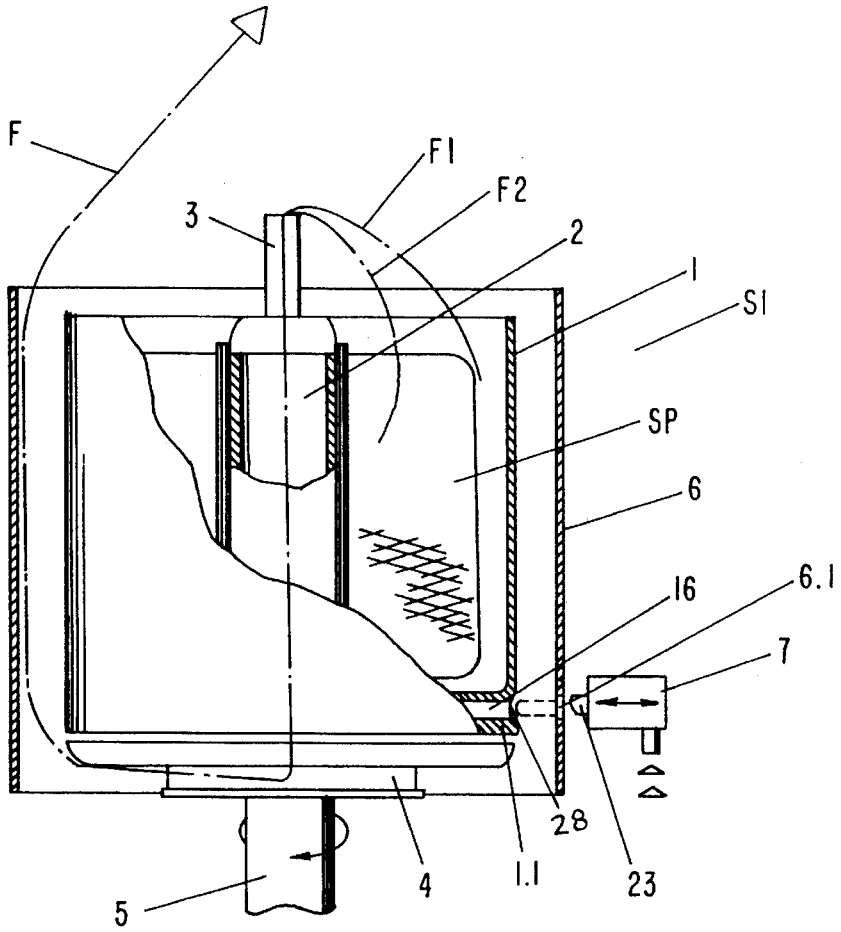
FIG. 1 shows a schematic side view in partial section of a two-for-one twisting spindle with a capsule thread brake, which may be actuated centrally.

FIG. 1 shows only those parts of a two-for-one twisting spindle S1 necessary for the following explanation of the capsule thread brake and its actuation, namely the bobbin carrier with its base 1.1 and protective pot 1 and the hub of the bobbin carrier with the hollow spindle shaft mounted therein, on which a supply bobbin SP is positioned, from which two threads F1 and F2 are withdrawn and fed through the thread feed tube 3 into the hollow spindle shaft 2 and passed through the capsule thread brake in a manner not evident from FIG. 1. The twisted thread F emerging radially from the thread storage disc 4 of the spindle rotor 5 is directed within the thread balloon between the shell of the protective pot 1 and a balloon limiter 6 upwards to a thread guide eyelet (not shown). The spindle rotor 5 is driven in rotational motion with a whorl.

The capsule thread brake, which will be explained in more detail below, inside the hub, respectively, hollow spindle shaft 2 of the bobbin carrier is actuated centrally by compressed air. For this purpose, a connector 7 is disposed outside the twisting spindle in the area of the lower edge of the protective pot 1. The connector is connected to a compressed air source via a compressed air supply line and has a slide piston 23, which may be moved radially toward the protective pot 1 of the bobbin carrier and may be attached through a bore 6.1 in the balloon limiter 6 to a connection opening 28 on the bobbin carrier base 1.1. A pressure line 16 is connected to the connection opening 28, and compressed air pulses can be passed therethrough.

The compressed air is supplied to the adjustment mechanism—to be explained below—in the same way as in the threading device known from German Patent 2 461 796 and U.S. Pat. No. 3,975,893.

Figure 2:
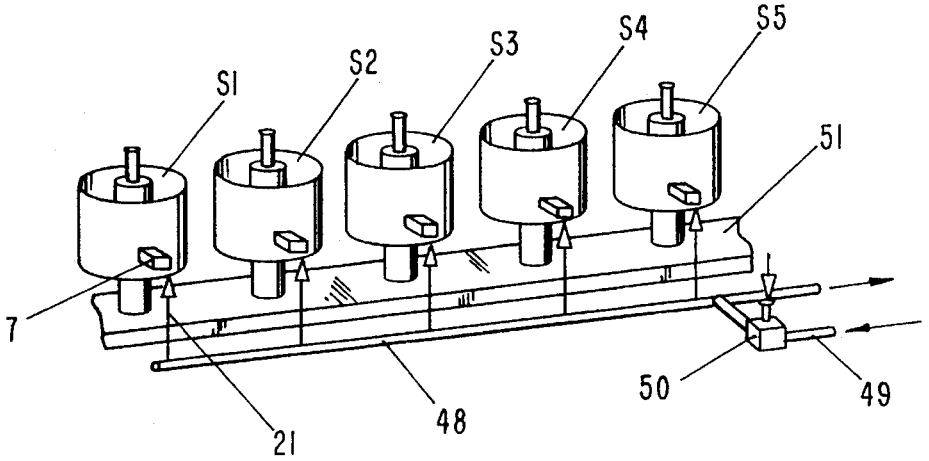
FIG. 2 shows a perspective view of a portion of a spindle bearing plate for a twisting machine with five twisting spindles, in which the capsule thread brakes may be actuated centrally.

As can be seen from FIG. 2, the compressed air is supplied via a compressed air supply line 48, which is guided along a spindle bearing plate 51 with twisting spindles S1 to S5 and to which the connectors 7 are connected via branch lines 21. The compressed air supply line 48 is connected to a compressed air source (not shown) via a supply line 49. The compressed air pulses, which lead to the adjustment (explained below) of all capsule thread brakes in the twisting spindles connected to the compressed air supply line 48 with the connectors 7, may be generated in said line 48 with the indicated control device 50.

The structure and operation of the adjustment mechanism for the capsule thread brakes will be explained in more detail below with the aid of FIGS. 3, 4, and 4*a* to 4*c*.

Figure 3:
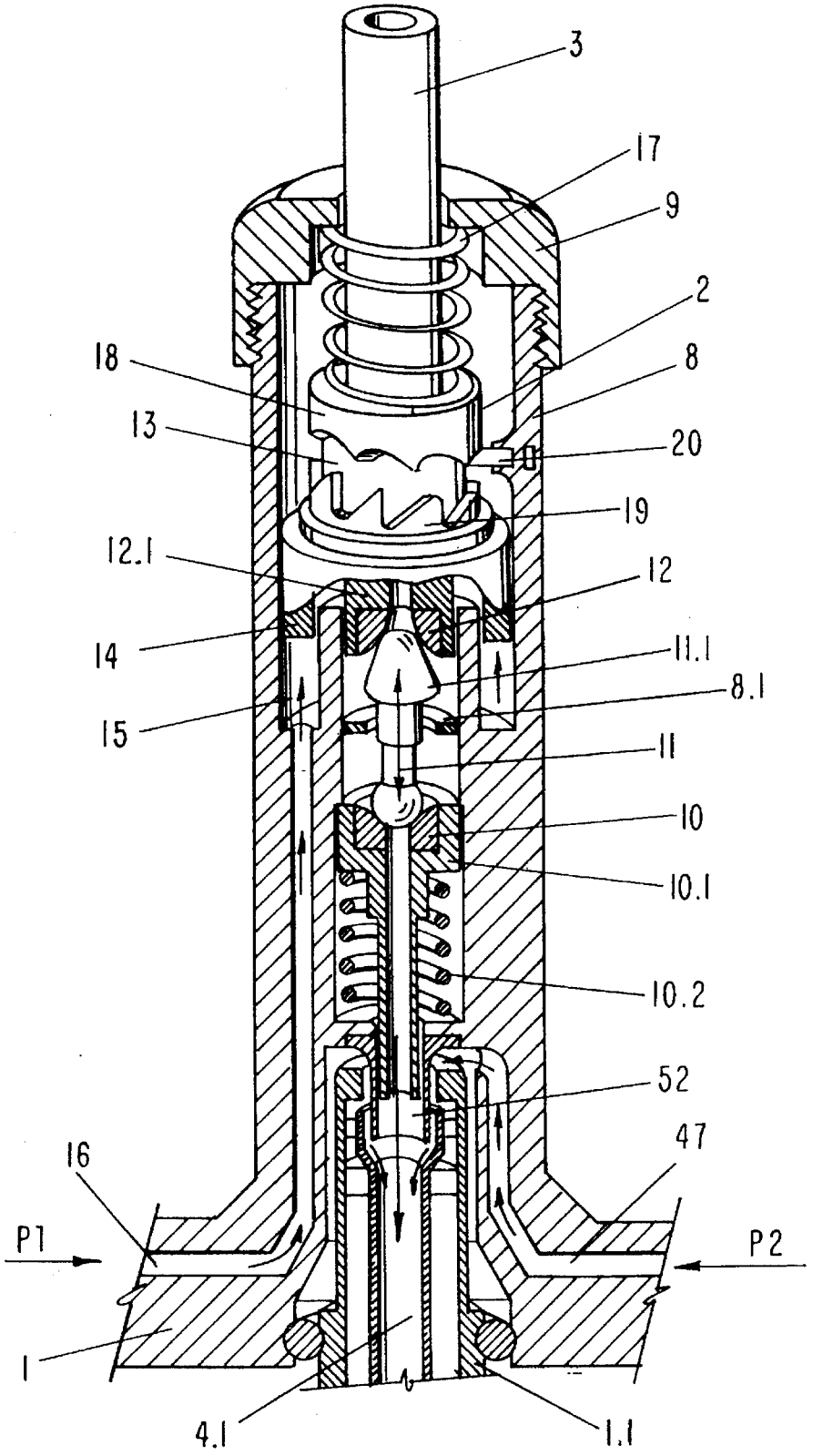
FIG. 3 shows a part-sectional view of the hollow spindle shaft of a twisting spindle according to FIG. 1 with an actuated capsule thread brake and an automatic threading device.

The capsule thread brake shown in FIG. 3 is inserted into the hub of the bobbin carrier as an extension to the hollow spindle shaft 2. It has a housing 8, which is sealed at the top by a screw-on housing cover 9 through which the thread feed tube 3 exits upwardly. The capsule thread brake arranged in the housing 8 has a first brake ring 10, which is arranged on the thread outlet side and is firmly connected to the housing 8 and on which a brake cartridge 11 is supported that is comprised of two sleeve portions 11 and 11.1 movable toward one another against a spring force in a known manner. A second brake ring 12, which is secured to a brake ring support 12.1 arranged on the lower end of a cylindrical guide element 13, sits on the upper end 11.1 of the brake cartridge 11. The guide element 13 may be moved in the axial direction and rotated with the upper brake ring support 12.1 inside the housing 8. Upward movement acts against the pressure from a pressure spring 17, which sits on a shoulder of the guide element 13 and is supported at its upper end on the underside of the cover 9.

Outside the second brake ring 12 and coaxially thereto a ring piston 14 is arranged on the guide element 13, which extends downward and is slidable in a ring cylinder (pressure cylinder) 15 disposed in the wall of the housing 8. The ring cylinder 15 is connected at its end opposite the ring piston 14 to the pressure line 16, which extends radially through the base 1.1 of the bobbin carrier to the connection opening 28 in the manner already described and as shown in FIG. 1.

As may also be seen from FIG. 3, the twisting spindle according to FIG. 1 is additionally provided with a threading device 51 of known design in the form of an injector, to which compressed air P2 may be supplied via a compressed air feed line 47. The brake ring support 10.1 for the lower brake ring 10 of the capsule thread brake is provided as a compressed air piston, which may be moved downward against the force of a helical spring 10.2. In the threading process a vacuum is generated by the action of the injector 52 underneath the brake ring support 10 such that the brake ring support 10.1 is moved downward and the lower brake ring 10 thus releases the brake cartridge 11. The brake cartridge 11 is held by a support ring 8.1 connected to the housing 8 in such a position that the thread fed through the thread feed tube 3 is sucked in past the brake cartridge 11 by the action of the vacuum ("under pressure") and is guided through a thread guide tube 4.1 into the thread storage disc 4. Such a device is known and described in DE-PS 3 243 157, for example.

A first upper toothed segment 18 and a second lower toothed segment 19 extend in the peripheral direction about the guide element 13. The downwardly extending teeth of the upper toothed segment 18 form with their intermediate spaces slots opening downwardly in the axial direction, whereby their slot bases form support shoulders arranged at different axial heights. On the support shoulders a radially inwardly protruding support stop 20 in the form of a positioning pin may abut depending in each case on the position of the rotatable guide element 13. The structure and arrangement of the upper toothed segment 18 and the lower toothed segment 19 may be seen in closer detail in FIGS. 4, 4*a*, 4*b* and 4*c*. The downwardly oriented teeth of the upper toothed segment 18 directly adjoin one another in the circumferential direction and each have a leading flank 18.2 extending from the slot base 18.1 in the circumferential direction UR in the form of a downwardly inclined surface relative to the circumferential direction UR that forms an angle of about 45° to the circumferential direction UR. The rearward flank 18.3 behind the slot base 18.1, on the other hand, extends at a small angle to the axial direction. Similarly, the lower toothed segment 19 has leading flanks 19.2 extending from the slot bases 19.1 in the circumferential direction UR in the form of upwardly inclined surfaces relative to the circumferential direction UR and forming an angle of about 45° to the circumferential direction UR. The rearward flanks 19.3 behind the slot bases 19.1 extends essentially in the axial direction. As may be seen in FIGS. 4, 4*a* to 4*c*, the lower toothed segment 19 is offset in the circumferential direction UR relative to the upper toothed segment 18 by about half the tooth spacing, which offset corresponds approximately to the diameter X of the support stop 20. Accordingly, the inclined leading flanks 18.2 of the upper toothed segment 18 lie opposite the slot bases 19.1 of the lower toothed segment 19, while the inclined leading flanks 19.2 of the lower toothed segment 19 lie opposite the slot bases 18.1 of the upper toothed segment 18.

Consequently, the raising and lowering of the guide element 13 causes it to rotate section by section (tooth by tooth) in the circumferential direction UR. The individual steps may be seen in FIGS. 4 and 4*a* to 4*c*. In FIG. 4*a*, the support stop 20 is located in the slot base 18.1 of the upper toothed segment 18 indicated at reference numeral I, with the guide element 13 in the lower position. When, as shown in FIG. 4*b*, the guide element 13 is raised in the direction of arrow H, the support stop 20, which is firmly connected to the housing 8, moves along the inclined surface (leading flank) 19.2 of the lower toothed segment 19 with the result that, in addition to the axial displacement in direction H, a movement component in the circumferential direction UR occurs, which directs the support stop 20 into the slot base 19.1 of the lower toothed segment 19, as shown in FIG. 4*b*. The upward movement of the guide element 13 in direction H is caused by feeding compressed air into the ring cylinder (pressure cylinder) 15 through the pressure line 16. On release of the compressed air from the ring cylinder 15, the direction of movement of the guide element 13 is reversed and a downward movement results in the direction of arrow T shown in FIG. 4*c*. Due to this downward movement, the support stop 20 is directed onto the inclined surface of the leading flank 18.2 of the toothed segment 18, which, in turn, results in a movement component in the circumferential direction UR so that, upon completion of the axial downward movement T, the support stop 20 now sits in the slot base 18.1 indicated with reference numeral II in FIGS. 4*a* to 4*c*. Accordingly, the guide element 13 together with the brake ring support 12.1 has been rotated in the circumferential direction UR by exactly one tooth spacing or slot base spacing. Since the slot base 18.1 indicated at II lies higher in the axial direction than the slot base 18.1 indicated at I, the brake ring 12 is also positioned in a correspondingly higher position. This results in a different adjustment of the brake force between the brake cartridge 11 of the capsule thread brake and the two brake rings 10 and 12. As may be seen from FIG. 4*c*, the slot base 18.1 of the upper toothed segment 18 indicated at III is similarly located at a higher level in the axial direction so that, by applying a further compressed air pulse, adjustment of the guide element 13 occurs in the aforementioned manner.

The path of the support stop 20 between the first and second teeth of the two toothed segments is illustrated in FIG. 4. From the slot base 18.1 the support stop 20 is displaced upon upward movement of the element 13 in the direction H into the position 20*a*, in which it meets the inclined leading flank 19.2. It slides along the leading flank 19.2 into position 20*b*. From there, on downward movement of the guide piece 13 in direction T, it reaches the position 20*c*. From here it passes along the leading flank 18.2' of the upper toothed segment 18 into the position 20*d* in the next slot base 18.1'. The angles of the inclined leading flanks 18.2 or 19.2 are selected in such a way as to allow the support stop 20 to slide in the circumferential direction UR without the risk of automatic locking.

The toothed segments 18 and 19 extend over the entire periphery of the guide element 13. The position of the slot bases, the arrangement of the inclined surfaces of the leading flanks, and the height of the teeth are such that the above-described movement of the support stop 20 together with the movement of the guide element 13 from a raised position into a substantially lowered position and back again into the initial raised position is assured over the entire periphery.

The supply of compressed air pulses operating the piston cylinder unit 14–15 is explained below in conjunction with FIGS. 5 and 6.

Figure 5:
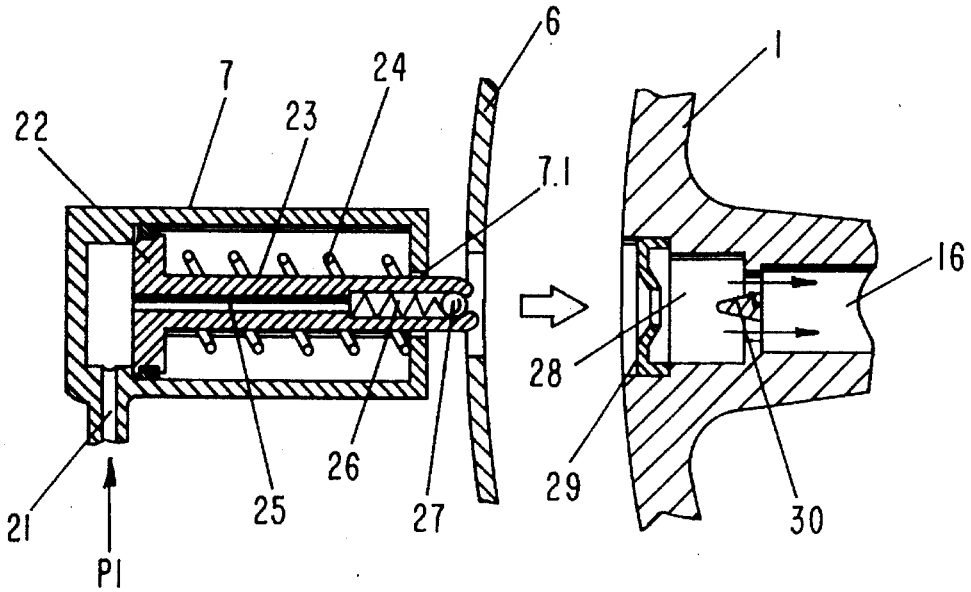
FIG. 5 shows an enlarged section of the view in FIG. 1 of a portion of the protective pot of the twisting spindle according to FIG. 1 with the connection opening and the connector for the compressed air.

FIG. 5 shows the connector 7, already indicated in FIG. 1, which is arranged outside the balloon limiter 6 in the area of the lower edge of the protective pot 1. The connector is in the form of a piston-cylinder unit, wherein the guide cylinder 7 is connected via line 21 to the compressed air supply line 48 shown in FIG. 2 and the slide piston 22 guided in the cylinder has a plunger 23 connected thereto as a connecting device. The plunger 23 projects from the guide cylinder 7 through an opening 7.1 on the side facing the balloon limiter 6. When the cylinder guide 7 is supplied with compressed air (line 21), the slide piston 22 is moved against the action of a piston spring 24. An axial duct 25, which is sealed at its outer end by means of a ball valve 27 biased by a valve spring 26 extends through the slide piston 22 and the plunger 23. The balloon limiter 6 is provided with a bore 6.1 in the area opposite the plunger 23, and in the corresponding area on the protective pot 1 a connection opening 28 is provided, to which the pressure line 16 is connected. A conical opening element 30 is provided in the connection opening 28. For sealing the plunger 23 when entering the connection opening 28, the connection opening 28 is provided with a gasket 29. When the guide cylinder 7 is supplied with compressed air (line 21), the slide piston 22 in FIG. 5 moves to the right and the plunger 23 moves outward. No compressed air is discharged from the front end of the plunger 23 in this case because the ball valve 27 is closed. When the plunger 23 is moved into the connection opening 28 and sealed by the gasket 29, and the conical opening element 30 penetrates the tip of the plunger 23, the ball valve 27 opens against the force of the valve spring 26, so that compressed air P1 can flow through the axial duct 25 and out of the line 21 into the pressure line 16.

This connector design has the advantage that, in an arrangement according to FIG. 2 with a central compressed air supply line and several connectors to be subjected to pressure, after the central compressed air supply line 48 has been supplied with compressed air, all pistons 22 initially move outward uniformly and only after the plungers 23 are in position an air loss occurs as a result of flow into the pressure line 16.

Figure 6:
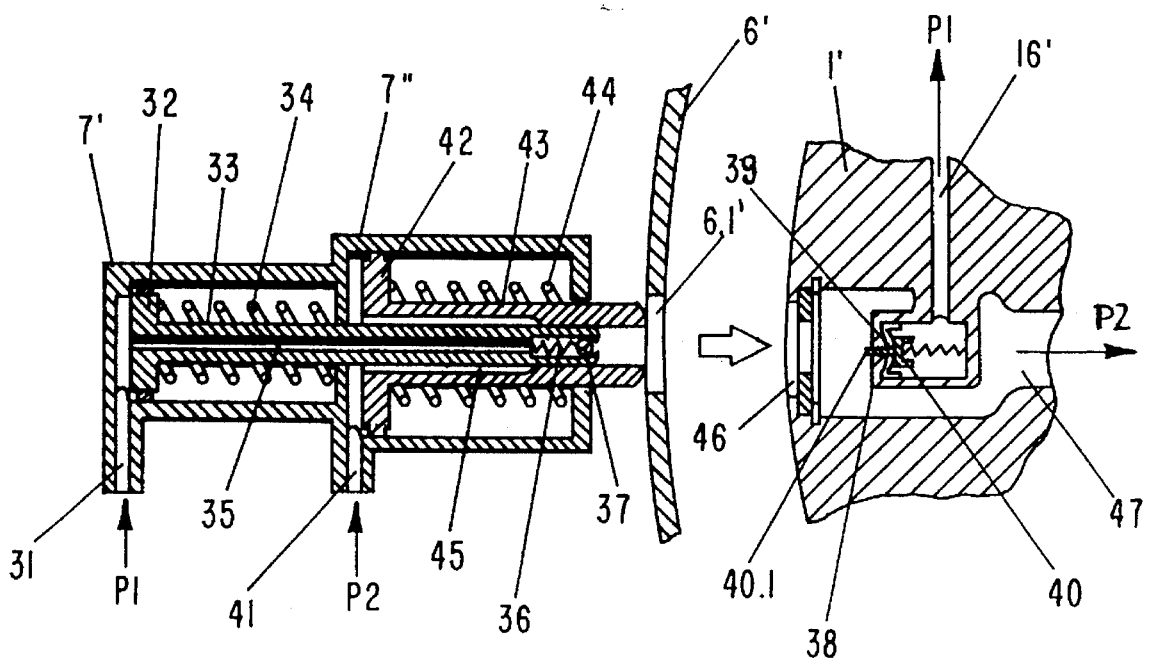
FIG. 6 shows a view analogous to FIG. 5 of an alternative structure for the connection opening and the connector for the supply of compressed air.

FIG. 6 shows another embodiment of a connector, which is a combination of a connector for actuation of the capsule thread brake and a connector for actuation of the threading device shown in FIG. 3.

The connector has two guide cylinders 7' and 7" arranged coaxially one behind the other, in which slide pistons 32 and 42, respectively, are guided. Plungers 33 and 43, respectively, are connected to the slide pistons 32, 42 and arranged coaxially such that plunger 33 is positioned inside the other. The guide cylinder 7' is connected to a first supply line 31, and the cylinder 7" is connected to a second supply line 41. The slide pistons 32 and 42 are moved against the pressure from piston springs 34 or 44. An axial duct 45 extends through the slide piston 42 and the plunger 43. The plunger 33 extends through the duct 45. The slide piston 32 and the plunger 33 are in provided with an axial duct 35. At the front end of the axial duct 35 within the inner plunger 33, a ball valve 37 is arranged, which is biased by a valve spring 36 to seal the outlet of the plunger 33. A bore 6.1' is provided in the balloon limiter 6' opposite the plungers 33 and 43, which are movable in the radial direction toward the protective pot 1'. The protective pot 1' is provided with a connection opening 46, to which the plunger 43 may be attached. The connection opening 46 is connected to a first pressure line 47 leading to the threading device 52. A connection element 38, at which the plunger 33 stops when moved outwardly, is provided inside the connection opening 46. This connection element is connected to the pressure line 16', which leads to the ring cylinder (pressure cylinder) 15 for operating the capsule thread brake. A valve 40 biased by a value spring and having an opening element 40.1 arranged externally is positioned behind a gasket 39 in the connection element 38 to seal the passage in the gasket.

The operation of the connector shown in FIG. 6 is as follows.

When the supply line 41 is subjected to pressure (compressed air P2), the slide piston 42 moves out radially to the protective pot 1' until the plunger 43 abuts at the connection opening 46. Compressed air passes through the axial duct 45 into the line 47 for operation of the threading device 52. When the supply line 31 is supplied with compressed air P1, the slide piston 32 moves out and the plunger 33 abuts at the connection element 38, in which case the valve 40 opens and the ball valve 37 is forced into the open position by the opening element 40.1. The compressed air flowing out of the line 31 now passes through the axial duct 35 into the pressure line 16' for operation of the capsule thread brake.

In this way, the threading device and the capsule thread brake may be operated independently of one another by using one connector.

Two further embodiments of devices for adjusting the capsule thread brakes in twisting machines, which like the arrangement described above are also combined with a threading device, are described below in conjunction with FIGS. 7 to 10.

A difference to the embodiment described above is that the compressed air for actuation of the capsule thread brake is not supplied radially but axially to the individual twisting spindles, whereas the compressed air for actuation of the threading device is supplied radially in the manner already described.

Figure 7:
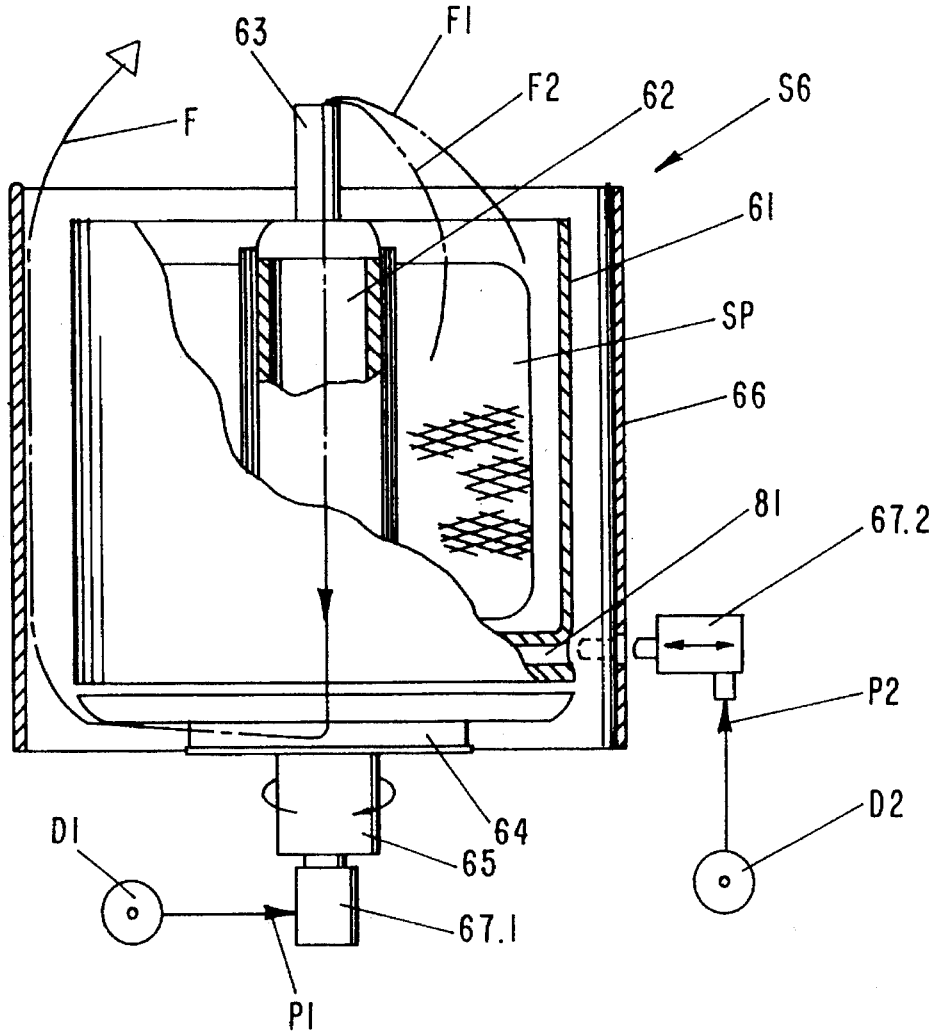
FIG. 7 shows a view analogous to FIG. 1 of a two-for-one twister with a capsule thread brake centrally actuated by an arrangement according to FIG. 9 or 10.
Figure 8:
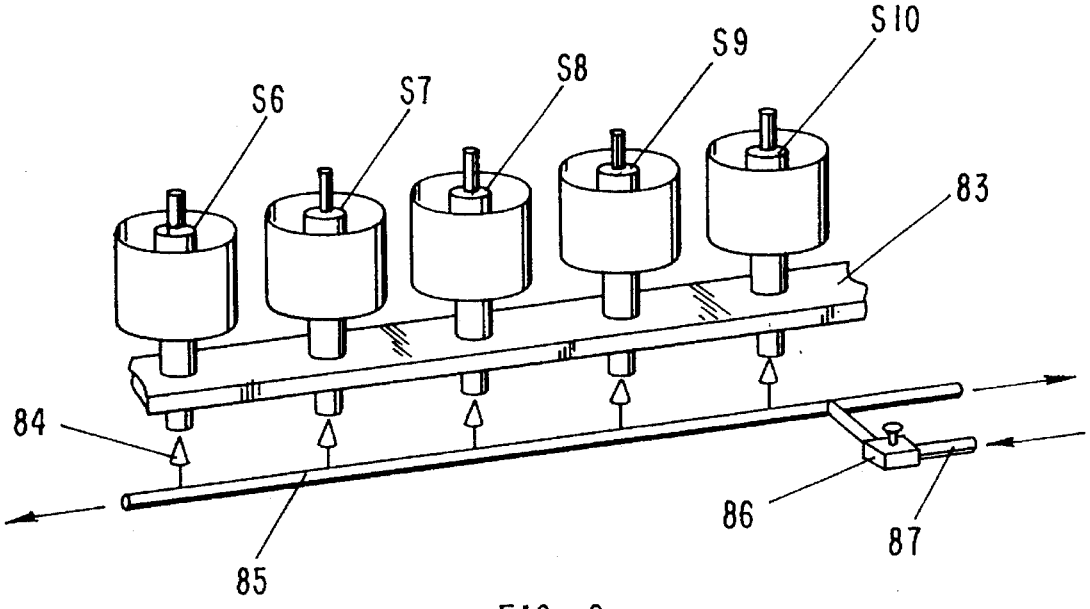
FIG. 8 shows a view analogous to FIG. 2 of a portion of a spindle bearing plate for a twisting machine with five twisting spindles, in which the capsule thread brakes may be actuated centrally by means of an arrangement according to FIGS. 9 or 10.

FIGS. 7 and 8, similar to FIGS. 1 and 2, serve to explain the basic structure of the twisting spindles and the arrangement of the twisting spindles on a spindle bearing plate.

FIG. 7 shows a two-for-one twisting spindle S6 with a bobbin carrier provided with a protective pot 61 and a bobbin carrier base 61.1. In the hub of the bobbin carrier, a hollow spindle shaft 62 is mounted, on which a supply bobbin SP is positioned, from which the threads F1 and F2 are withdrawn and fed through the thread feed tube 63 into the hollow spindle shaft 62 and guided through the capsule thread brake. The thread F emerges at the thread storage disc 64 of the spindle rotor and, as already described, is guided between the shell of the protective pot 61 and a balloon limiter 66 upwards to the thread guide eyelet (not shown). Two connectors for the supply of compressed air are provided outside the twisting spindle, i.e. a connector 67.1, which is connected to a pressure source D1 to supply compressed air P1 to actuate the capsule thread brake, and a connector 67.2, which is connected to a compressed air source DE to supply compressed air P2 to actuate the threading device. The latter connector 67.2 is not described in further detail below and may have a structure known per se, e.g., as shown in FIG. 5 and described in conjunction with this Figure.

As may be seen from FIG. 8, the compressed air for actuation of the capsule thread brake is supplied via a compressed air supply line 85 running along a spindle bearing plate 83 with twisting spindles S6 to S10 and with connectors 67.1 connected to it via branch lines 84. As already described, the compressed air supply line 85 is connected via a supply line 87 to the compressed air source (not shown). Compressed air pulses may be generated in the compressed air supply line 85 by the control device 86 resulting in adjustment of all capsule thread brakes in the twisting spindles connected to the compressed air supply line 85 via connectors 67.1.

The compressed air supply line with its branch lines connected to the connectors 67.2 is not shown in FIG. 8.

Figure 9:
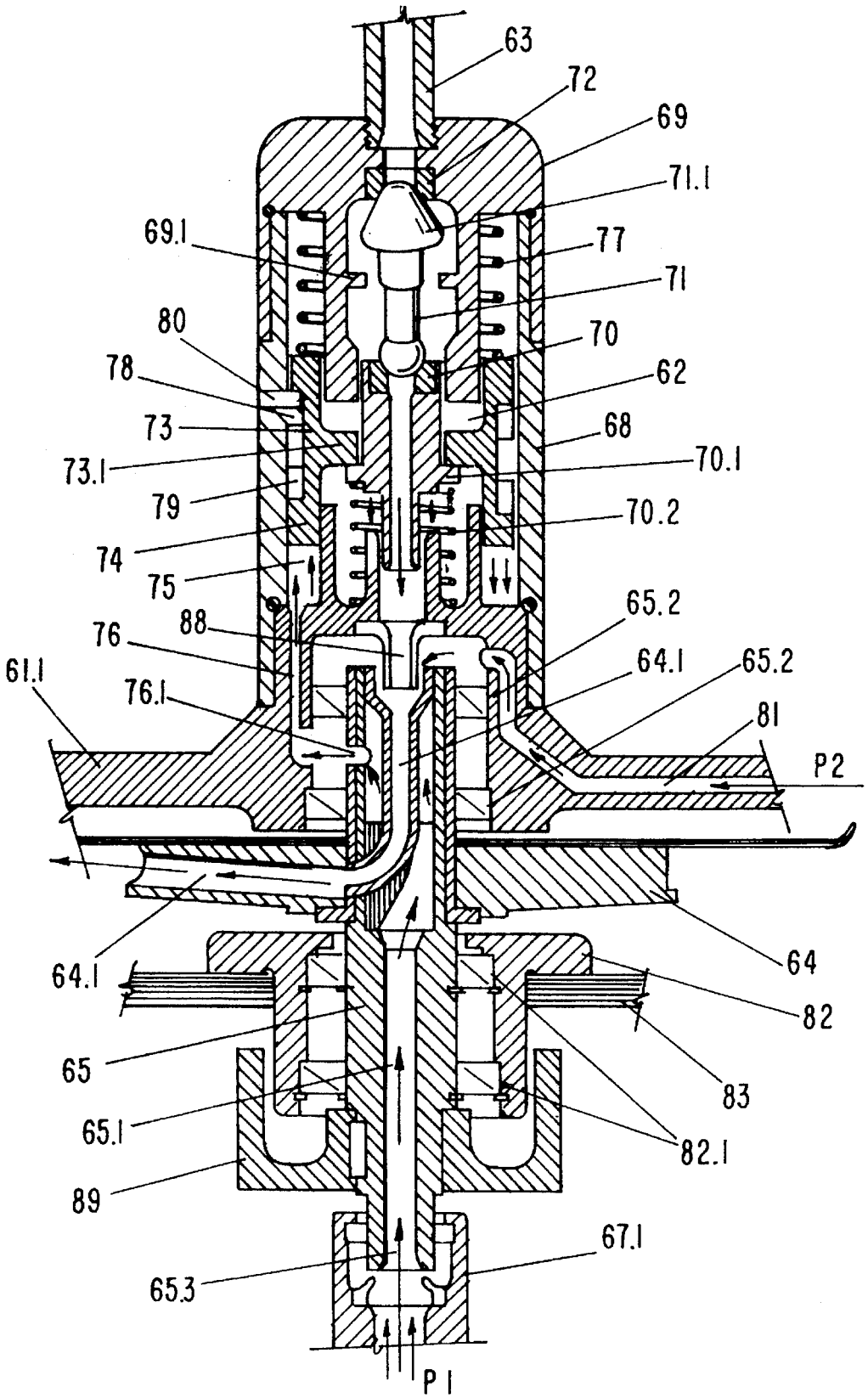
FIG. 9 shows a partial section similar to FIG. 3 of the hollow spindle shaft of a twisting spindle according to FIG. 7 with an actuated capsule thread brake and an automatic threading device.

FIG. 9 shows the bobbin carrier and the hollow spindle shaft as well as the spindle rotor of a twisting spindle in section. The hollow spindle shaft 62 has a housing 68 sealed at its top by a screw-on housing cover 69, to which the thread feed tube 63 is connected. The capsule thread brake is disposed inside the screw-on cover 63 with the upper brake ring 72 arranged on the thread feed side and firmly connected to the housing 68. The axially movable, lower brake ring 70 and the brake cartridge comprising the sleeve parts 71 and 71.1 are arranged between the two brake rings 70, 72. The housing 68 is supported on the base 61.1 of the bobbin carrier. The lower brake ring 70 is disposed on an essentially tubular brake ring support 70.1, which is supported at its underside on the housing 68 with a pressure spring 70.2 in such a way that it may slide axially in the housing 68 against the bias of this pressure spring 70.2. Coaxially above this lower brake ring support 70.1, a guide element 73, essentially in the form of a hollow cylinder, is provided. It is supported via an inside shoulder 73.1 on a corresponding outward shoulder of the lower brake ring support 70.1. The guide element 73 is supported on its upper side with a compression spring 77 on the cover 69 of the housing 68. The design of the two springs 70.2 and 77 is such that the compression spring 77 has a stronger spring force than the first pressure spring 70.2. The lower section of the guide element 73 is in the form of a ring piston 74, which extends downward and away from the brake cartridge 71 and which is guided in a ring cylinder (pressure cylinder) 75 disposed in the housing 68. A pressure line 76 extends from the ring cylinder 75 and into the base 61.1 of the bobbin carrier and is connected via a passage 76.1 to a supply line 65.1 extending outward and axially through the spindle rotor 65. The spindle rotor 65 with the thread storage disc 64 is rotatably mounted in the bobbin carrier base 61.1 via bearings 65.2, and has a whorl 89 as drive means on its lower end. The spindle rotor 65 is mounted in the spindle bearing plate 83 via further bearings 82.1 and mountings 82. At the lower end of the spindle rotor 65 the supply line 65.1 feeds into a connection opening 65.3, to which a connector 67.1 is connected for the supply of compressed air pulses P1.

An upper toothed segment 78 and a lower toothed segment 79 extend about the periphery of the guide element 73. The upper toothed segment 78 corresponds to the upper toothed segment 18 described in conjunction with FIG. 3 and the lower toothed segment 79 to the described lower toothed segment 19. A radially inwardly protruding support stop 80 provided in the housing 68 as a positioning pin engages between the toothed segments 78 and 79. The structure and arrangement of the two toothed segments 78 and 79 is shown in closer detail in FIGS. 4 and **4*a* to 4*c*, already discussed. The operation of the toothed segments 78 and 79** corresponds exactly to the operation already described in conjunction with these Figures and therefore will not be explained again here.

The arrangement of the toothed segments 78 and 79 on the guide element results in that the raising and lowering of the guide element 73 causes it to rotate section by section (tooth by tooth) in the circumferential direction. The upward and downward movement of the guide element 73 is caused by supplying compressed air pulses to the ring cylinder (pressure cylinder) 75 to move the ring piston 74. The positioning of the guide element 73 at different heights in relation to the upper brake ring 72 fixed in the housing, which may be achieved in the described way, also applies to the lower brake ring support 70.1, since this constantly abuts the inside shoulder 73.1 of the guide element 73 due to bias of the pressure spring 70.2. The selection of the spring force of the two springs 70.2 and 77 assures that the pressure spring 70.2 only raises the lower brake ring support 70.1 until it abuts against the guide element 73, while the latter cannot be raised against the bias of the compression spring 77. In this way, the brake ring support 70.1 together with the lower brake ring 70 adjusts to the different height positions determined by the position of the guide element 73, which results in different adjustments of the brake force between the brake cartridge 71 of the capsule thread brake and the two brake rings 70 and 72.

The threading device of the twisting spindle according to FIG. 9 is conventionally provided with an injector 88, which may be supplied with compressed air P2 via a compressed air supply line 81 guided through the bobbin carrier base 61.1. In this way, a vacuum is generated at the injector 88 which applies a force on the underside of the lower brake ring support 70.1 in the form of a piston surface. This force causes the brake ring support 70.1 to move downward against the bias of the pressure spring 70.2 with the result that the lower brake ring 70 releases the brake cartridge 71, which is firmly held by a support ring 69.1 disposed in the housing cover 69 of the housing 68 in such a position that the thread fed through the thread feed tube 63 is sucked in past the brake cartridge 71 due to the vacuum ("underpressure"), and is guided through the thread guide tube 64.1 into the thread storage disc 64. Since in the resting position the guide element 73 is firmly held by the support stop 80, the brake ring support 70.1 is lifted downward from the guide element 73 during the threading process, and abuts against the underside of the inside shoulder 73.1 once again after threading due to the bias from the pressure spring 70.2.

Figure 10:
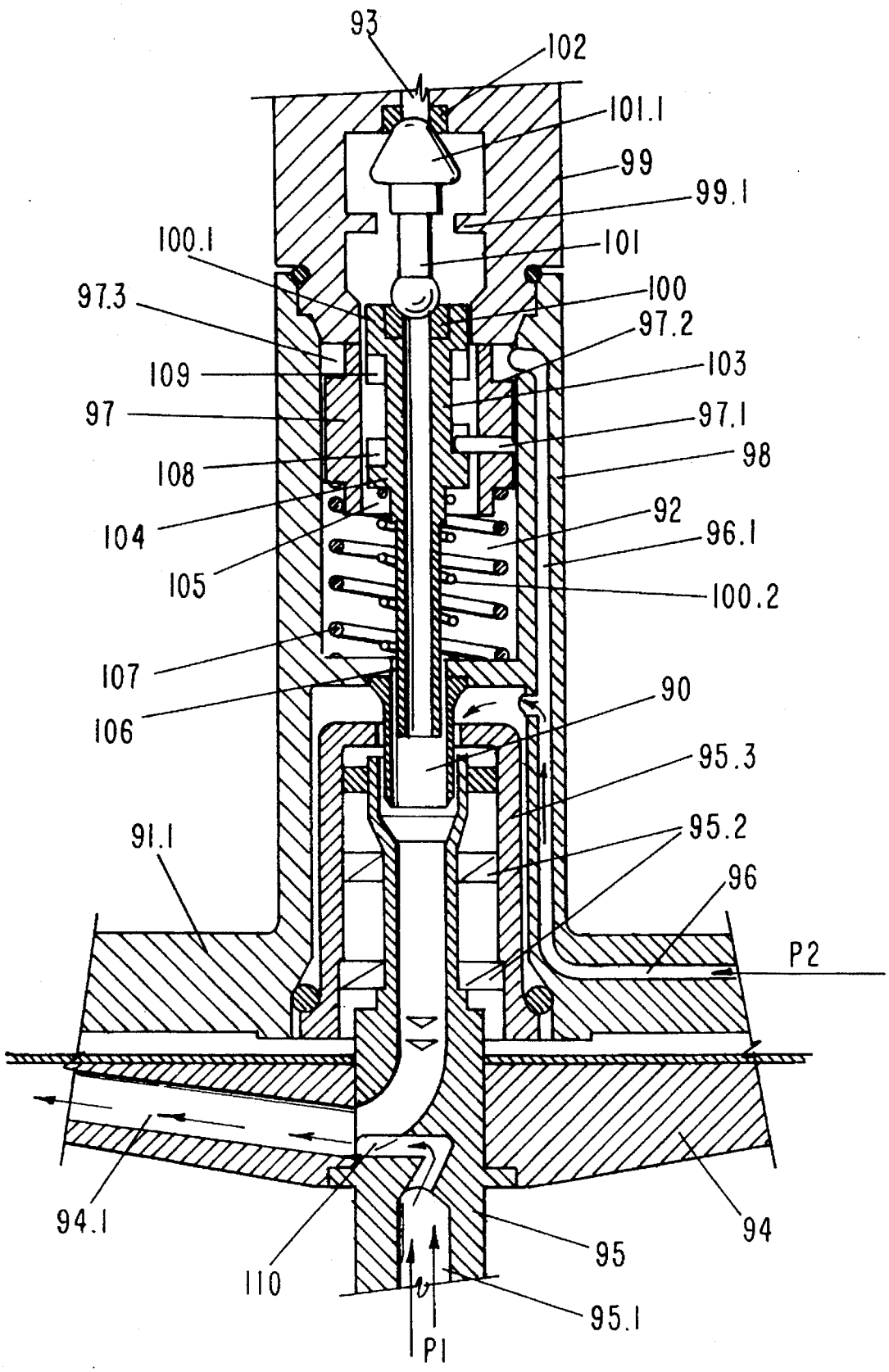
FIG. 10 shows a view similar to FIG. 3 in partial section of the hollow spindle shaft of a twisting spindle according to FIG. 7 with a further embodiment of an actuated capsule thread brake and an automatic threading device.

In the case of the hollow spindle shaft of a twisting spindle shown in FIG. 10, the capsule thread brake is also actuated by compressed air supplied axially through the spindle rotor, whilst the compressed air for actuation of the threading device is supplied radially to the twisting spindle. Hence, the arrangement shown in FIGS. 7 and 8 also essentially applies for the arrangement of the twisting spindles and the compressed air supply line.

In the twisting spindle according to FIG. 10, the hollow spindle shaft 92 has a housing 98 connected at its top to a screw-on housing cover 99. The thread feed tube 93 extends upwardly from the cover. A capsule thread brake comprising parts 101 and 101.1 is disposed in the screw-on housing cover 99 and supported on an upper brake ring 102 firmly connected to the screw-on housing cover 99 and on a lower brake ring 100 movable in the axial direction. The lower brake ring 100 is arranged on a brake ring support 100.1 disposed on the top of a guide element 103 and integrally connected thereto. The guide element 103 may be moved axially and rotated and is supported at its underside in the form of piston 104 in the housing 98 by a pressure spring 100.2.

An upper toothed segment 109 and a lower toothed segment 108 are arranged on the mantle surface of the guide element 103, each extending in the circumferential direction. Between the two toothed segments a radially inwardly directed support stop 97.1 is positioned which is secured to an additional axially movable guide member 97 essentially in the form of a hollow cylinder arranged coaxially outside the guide element 103. The additional guide member 97 is supported on its underside in the housing 98 with a compression spring 107. The design of the two springs 100.2 and 107 is such that the compression spring 107 has a stronger spring force than the first pressure spring 100.2.

The piston 104 provided at the guide element 103 is positioned in a pressure cylinder 105 arranged in the additional guide member 97. This pressure cylinder 105 is connected to the inner area of the thread guide tube 94.1, arranged in the spindle rotor 95, via a passage 106. An injector 110 connected to a supply line 95.1 extending axially outwardly through the spindle rotor 95 opens into the section of the thread guide tube 94.1 pointing radially outward. The supply line 95.1 opens into the connection opening in a manner which is not shown. A connector similar to the connector 67.1 shown in FIG. 9 is connected to the connection opening for the supply of compressed air.

In the rest position of the guide element 103, the support stop 97.1 abuts at one of the slot bases constituting the support shoulders in the lower toothed segment 108. When the guide element 103 moves axially downward, the processes are the same as those described in conjunction with the first mentioned embodiment in FIGS. 4 and **4*a*–4*c*. In this case, the lower toothed segment 108 in FIG. 10 corresponds to the upper toothed segment 18 in FIG. 4, whilst the upper toothed segment 109 in FIG. 10 corresponds to the lower toothed segment 19 in FIG. 4**.

The guide element 103 is moved by supplying a compressed air pulse P1 through the supply line 95.1, which as a result of the action of the injector 110 leads to a vacuum pulse ("under pressure pulse") in the thread guide tube 94.1, which passes through the passage 106 and acts on the piston 104, moving the piston 104 downward. After the external pressure has been reestablished, the piston 104 together with the guide element 103 moves upward again due to the bias of the first pressure spring 100.2. In the manner already described in association with the other embodiments, the guide element 103 together with the lower brake ring 100 are positioned at a different level in relation to the upper brake ring 102 as a consequence of the rotation of the guide element 103, thus resulting in a different adjustment of the brake force at the brake cartridge. The different design of the two pressure springs 100.2 and 107 assures that the additional guide element 97 does not move upward with the guide element 103 when there is a vacuum.

The spindle rotor 95 with the thread storage disc 94 is flexibly received and rotatably mounted in the housing via bearings 95.2 and a bearing bush 95.3. The threading device for the twisting spindle shown in FIG. 10 is provided in a known manner with an injector 90, which is inserted into the upper portion of the thread guide tube 94.1 and is connected to a compressed air inlet 96, which is guided through the housing 98 and in the radial direction through the bobbin support base 91.1 outward to a connection opening (not shown) via which the compressed air pulses P2 are supplied. The guide member 97 is also in the form of a ring piston 97.2 on its upper side, which is arranged inside a ring cylinder 97.3. The ring cylinder 97.3 is connected to the compressed air inlet 96 via a branch line 96.1. The compressed air supplied through the compressed air inlet 96 generates a vacuum for sucking in the threads at the injector 90. At the same time the additional guide member 97 is moved downward by the ring piston 97.2 against the bias of the compression spring 107. In this case, the guide element 103 together with the lower brake ring support 100.1 are moved downward together with the brake ring 100 by the action of the support stop 97.1. Thus, during threading the brake cartridge 101, 101.1 is released from the lower brake ring 100 and is held by the support ring 99.1 arranged in the screw-on cover 99 so that the supplied thread is sucked in past the brake cartridge 101, 101.1 as a result of the vacuum and can be fed into the thread guide tube 94.1.

The present invention is, of course, in no way restricted to the specific disclosure of the specification and drawings, but also encompasses any modifications within the scope of the appended claims.

What I claim is:

1. A device for adjusting the braking power of capsule thread brakes of spindles of at least one twisting machine, said device comprising:

a plurality of twisting spindles each having a bobbin carrier with a hub and a capsule thread brake with a step-wise adjustable braking power positioned in said hub, said capsule thread brake having a longitudinal center axis defining an axial direction of said capsule thread brake and comprising:

a) two brake rings arranged axially spaced from one another, b) a brake cartridge supported between said two brake rings, wherein the braking power is adjusted by axially displacing and rotating one of said brake rings, thereby changing a distance between said brake rings and thus a force of said brake rings acting on said brake cartridge, and c) a pressure cylinder acting on one of said brake rings;

a common compressed air supply line for supplying compressed air, said compressed air supply line having a control device;

a connector connected to each said spindle, wherein said compressed air supply line communicates via said connectors with said pressure cylinders, wherein said control device supplies compressed air pulses through said common compressed air supply line and said connectors to said pressure cylinders to affect simultaneously an axial displacement by a predetermined distance of one of said brake rings of all said capsule thread brakes.

2. A device according to claim 1, wherein each said capsule thread brake has a cylindrical housing through which housing the thread is guided in an axial direction of said capsule thread brake, wherein a first said brake ring is positioned at a lower end of said housing, wherein said brake cartridge is supported on said first brake ring and a second said brake ring is positioned at an upper end of said brake cartridge, said device further comprising:

a cylindrical brake ring support for supporting one of said brake rings, said brake ring support arranged so as to be axially slidable and rotatable within said housing;

a pressure spring for supporting said brake ring support at said housing, said pressure spring resting with one end on a side of said brake ring support opposite said brake ring and with the other end on said housing;

a cylindrical guide element connected to said brake ring support so as to be axially slidable and rotatable within said housing together with said brake ring support;

said guide element having a first toothed segment with first teeth distributed directly adjacent to one another in the circumferential direction of said guide element, said first teeth defining therebetween first axial slots with a first slot bottom, wherein said first slot bottoms are positioned at different axial heights of said guide element, wherein a leading flank of said first axial slots in the circumferential direction extends downwardly at an acute angle of less than 90° to the circumferential direction and wherein a rearward flank of said first axial slots in the circumferential direction extends substantially axially;

said guide element having a second toothed segment with second teeth distributed directly adjacent to one another in the circumferential direction of said guide element, said second toothed segment positioned opposite said first toothed segment, wherein said second teeth define therebetween second axial slots with a second slot bottom, said second axial slots opening toward said first axial slots, wherein a leading flank of said second axial slots in the circumferential direction extends upwardly at an acute angle of less than 90° to the circumferential direction and wherein a rearward flank of said second axial slots in the circumferential direction extends substantially axially, wherein said first and second teeth are spaced from one another within said first and second toothed segments at a selected spacing;

said guide element having a second toothed segment with second teeth distributed directly adjacent to one another in the circumferential direction of said guide element, said second toothed segment positioned opposite said first toothed segment, wherein said second teeth define therebetween second axial slots with a second slot bottom, said second axial slots opening toward said first axial slots, wherein a leading flank of said second axial slots in the circumferential direction extends upwardly at an acute angle of less than 90° to the circumferential direction and wherein a rearward flank of said second axial slots in the circumferential direction extends substantially axially;

said second toothed segment being staggered in the circumferential direction relative to said first toothed segment such that said leading flanks of said first axial slots are positioned opposite said slot bottoms of said second axial slots and said leading flanks of said second axial slots are positioned opposite said slot bottoms of said first axial slots;

a radially inwardly projecting support stop for engaging said axial slots of said first toothed segment such that as a function of an angular position of said guide element in a circumferential direction said support stop is inserted into said axial slots and brought into contact with said slot bottoms;

said pressure cylinder positioned within said housing;

a piston connected radially outwardly to said guide element so as to be coaxial thereto, said piston guided within said pressure cylinder;

said pressure cylinder communicating with said compressed air supply line via a first end of said pressure cylinder remote from said piston;

a pressure line connected to said first end of said pressure cylinder and guided through said housing to a connection opening external to said bobbin carrier; and said connector having a first movable connecting device connected to said compressed air supply line for connecting said connector to said connection opening positioned opposite to said first connecting device of said connector.

3. A device according to claim 2, wherein said acute angle of said leading flank of said first teeth is equal to said acute angle of said leading flank of said second teeth.

4. A device according to claim 2, wherein said axial heights of said slot bottoms of said first teeth decrease in one direction about the circumference and a height of said second teeth increases in said same direction about the circumference.

5. A device according to claim 2, wherein said first toothed segment is staggered relative to said second toothed segment by a distance that equals substantially 0.4 to 0.6 said selected spacing between said teeth.

6. A device according to claim 2, wherein:

said guide element is arranged coaxially to said brake ring support and is fixedly connected thereto;

said brake ring support supports said second brake ring and is rotatable;

said support stop is fixedly connected to an inner wall of said housing;

said piston is a ring piston extending toward said brake cartridge;

said pressure cylinder is a ring cylinder, wherein said pressure line is guided through a bottom of said bobbin carrier radially outwardly; and said bobbin carrier has a protective pot, with said connection opening positioned in said protective pot.

7. A device according to claim 6, wherein:

said connector comprises a guide cylinder connected to said compressed air supply line, a slide piston guided within said guide cylinder, and a piston spring biasing said slide piston into an end position within said guide cylinder remote from said bobbin carrier;

said slide piston is movable radially relative to said bobbin carrier from said end position against the force of said piston spring toward said bobbin carrier;

said first connecting device is connected to said slide piston and is in the form of a plunger extendable from and retractable into said guide cylinder, said plunger having a free end with a ball valve comprising a valve spring for biasing said ball valve into a closed position;

said connection opening has a receiving element for said plunger, said receiving element having a conical opening element fixedly connected thereto that upon introduction of said plunger into said connection opening opens said ball valve.

8. A device according to claim 7, wherein said connection opening further comprises a gasket.

9. A device according to claim 7, wherein said bobbin carrier further comprises a balloon limiter and said balloon limiter has a bore opposite said connector which bore is penetrated by said plunger when said plunger is displaced radially toward said bobbin carrier.

10. A device according to claim 6, wherein:

said bobbin carrier further comprises a compressed air supply unit for a threading device;

said connector comprises a first guide cylinder connected to said compressed air supply line, a first slide piston guided within said first guide cylinder, and a first piston spring biasing said first slide piston into an end position within said first guide cylinder remote from said bobbin carrier;

said connector further comprises a second guide cylinder connected to a further compressed air supply line, a second slide piston guided within said second guide cylinder, and a second piston spring biasing said second slide piston into an end position within said second guide cylinder remote from said bobbin carrier, said second guide cylinder positioned adjacent to said first guide cylinder so as to be coaxial to said first guide cylinder;

said first slide piston is movable radially relative to said bobbin carrier from said end position against the force of said first piston spring toward said bobbin carrier;

said second slide piston is movable radially relative to said bobbin carrier from said end position against the force of said second piston spring toward said bobbin carrier;

said first connecting device is connected to said first slide piston and is in the form of a first plunger extending from said first guide cylinder, wherein said first plunger has an axially extending compressed air channel;

said connector further comprises a second movable connecting device that is connected to said second slide piston and is in the form of a second plunger extending from said first guide cylinder, wherein said first plunger extends coaxially into said second plunger and has a length such that, when said first slide piston is displaced from said end position toward said bobbin carrier, said first plunger projects past a free end of said second plunger;

said connection opening receives said second plunger; and said bobbin carrier has a receiving element for said first plunger positioned radially inwardly relative to said connection opening, wherein said connection opening is connected to a compressed air feed line connected to the threading device and wherein said receiving element is connected to said pressure line connected to said pressure cylinder.

11. A device according to claim 10, wherein:

said receiving element has a sealing device for sealing the interior of said receiving element relative to the interior of said connection opening;

said sealing device comprises a valve element and a spring for biasing said valve element into a closed position; and said valve element is displaced into an open position by said first plunger when said first plunger is displaced by said first slide piston toward said bobbin carrier and is inserted into said receiving element.

12. A device according to claim 11, wherein:

said first plunger has a free end with a ball valve comprising a valve spring for biasing said ball valve into a closed position for closing off said compressed air channel; and said valve element has an opening element for opening said ball valve when said first plunger is introduced into said receiving element.

13. A device according to claim 10, wherein said bobbin carrier further comprises a balloon limiter and said balloon limiter has a bore opposite said connector penetrated by said first and said second plungers when said first and said second plungers are displaced radially toward said bobbin carrier.

14. A device according to claim 2, wherein:

said brake ring support supports said first brake ring;

said pressure spring biases said brake ring support in an upward direction;

said guide element is positioned coaxially and radially outwardly relative to said brake ring support and is supported on said brake ring support and comprises a compression spring for biasing said guide element in a downward direction against the force of said pressure spring;

said compression spring has a greater spring force than said pressure spring;

said support stop is fixedly connected to an inner wall of said housing;

said piston is a ring piston extending away from said brake cartridge;

said pressure cylinder is a ring cylinder, wherein said pressure line is axially guided through a bottom of said bobbin carrier; and said bobbin carrier has a spindle rotor and a supply channel for supplying compressed air extending axially through said spindle rotor, said supply channel having at an outer end thereof said connection opening.

15. A device according to claim 1, wherein each said capsule thread brake has a cylindrical housing through which housing the thread is guided in an axial direction of said capsule thread brake, wherein a first said brake ring is positioned at a lower end of said housing, wherein said brake cartridge is supported on said first brake ring and a second said brake ring is positioned at an upper end of said brake cartridge, said device further comprising:

a cylindrical brake ring support for supporting said first brake ring, said brake ring support arranged so as to be axially slidable and rotatable within said housing;

a pressure spring for supporting said brake ring support at said housing, said pressure spring resting with one end on a side of said brake ring support opposite said brake ring and with the other end on said housing for biasing said brake ring support in an upward direction;

a cylindrical guide element axially slidable and rotatable within said housing together with said brake ring support and coaxially fixedly connected to said brake ring support;

said guide element having a first toothed segment with first teeth distributed directly adjacent to one another in the circumferential direction of said guide element, said first teeth defining therebetween first axial slots with a first slot bottom, said axial slots opening toward said brake cartridge, wherein said first slot bottoms are positioned at different axial heights of said guide element, wherein a leading flank of said axial slots in the circumferential direction extends upwardly at an acute angle of less than 90° to the circumferential direction and wherein a rearward flank of said axial slots in the circumferential direction extends substantially axially;

said guide element having a second toothed segment with second teeth distributed directly adjacent to one another in the circumferential direction of said guide element, said second toothed segment positioned opposite said first toothed segment, wherein said second teeth define therebetween second axial slots with a second slot bottom, said second axial slots opening toward said first axial slots, wherein a leading flank of said second axial slots in the circumferential direction extends downwardly at an acute angle of less than 90° to the circumferential direction and wherein a rearward flank of said second axial slots in the circumferential direction extends substantially axially; said second toothed segment being staggered in the circumferential direction relative to said first toothed segment such that said leading flanks of said first axial slots are positioned opposite said slot bottoms of said second axial slots and said leading flanks of said second axial slots are positioned opposite said slot bottoms of said first axial slots;

a radially inwardly projecting support stop for engaging said axial slots of said first toothed segment such that as a function of an angular position of said guide element in a circumferential direction said support stop is inserted into said first axial slots and brought into contact with said slot bottoms of said first axial slots; a guide member positioned radially outwardly and coaxially to said guide element and axially slidable;

said support stop fixedly connected to an inner wall of said guide member; said guide member comprising a compression spring biasing said guide member in an upward direction;

said compression spring having a greater spring force than said pressure spring;

said pressure cylinder positioned within said guide member;

a piston connected radially outwardly to said guide element so as to be coaxial thereto, said piston guided within said pressure cylinder;

said pressure cylinder communicating with said compressed air supply line via a first end of said pressure cylinder;

said connector having a first movable connecting device connected to said compressed air supply line for connecting said connector to said connection opening positioned opposite to said first connecting device of said connector;

said bobbin carrier comprising a spindle rotor having a thread guide tube with an outwardly extending section and having an inlet channel extending axially through said spindle rotor and having at an outer end thereof said connection opening;

said pressure cylinder communicating via a through opening with said thread guide tube; and said bobbin carrier further having an injector connected to said inlet channel and opening into said outwardly extending section.

16. A device according to claim 15, wherein:

said guide member at an upper end thereof is in the form of an annular piston guided within an annular cylinder;

said bobbin carrier further comprises a threading device with an injecting member and a compressed air inlet; and said annular cylinder has a connecting line communicating with said compressed air inlet of said threading device.

* * * * *